United States Patent [19]

Dorm

[11] Patent Number: 4,866,789

[45] Date of Patent: Sep. 19, 1989

[54] PROTECTIVE BODY SUIT

[75] Inventor: Dwight Dorm, York, Pa.

[73] Assignee: Dormco, Inc., Wilmington, Del.

[21] Appl. No.: 553,695

[22] Filed: Nov. 21, 1983

[51] Int. Cl.[4] ..... A41D 13/00

[52] U.S. Cl. ..... 2/2; 2/92; 450/96

[58] Field of Search ..... 2/2, 2.5, 44, 45, 69, 2/67, 92, 22, 78 C, 78 A, 78 R; 128/518 R, 520, 106, 117

[56] References Cited

U.S. PATENT DOCUMENTS

| | | | |
|---|---|---|---|
| 1,501,802 | 7/1924 | Oppenheim | 2/78 C |
| 1,602,454 | 10/1926 | Riddell | 2/23 |
| 2,352,128 | 6/1944 | Shikles | 2/78 C |
| 2,437,989 | 3/1948 | Artzt et al. | 2/78 A |
| 2,663,022 | 12/1953 | Aaronson | 2/78 R |
| 2,799,023 | 7/1957 | Goodman | 2/78 R |
| 3,023,419 | 3/1962 | Strahle | 2/78 R |
| 3,135,961 | 6/1964 | Roderick | 2/2 |
| 3,170,163 | 2/1965 | Mitchell | 2/2 |
| 3,452,362 | 7/1969 | Korolick et al. | 2/92 X |
| 3,514,786 | 6/1970 | Terwilliger | 2/2.5 |
| 3,771,171 | 11/1973 | Mitchell | 2/2.5 |
| 3,909,847 | 10/1975 | Holt et al. | 2/2 |
| 4,100,620 | 7/1978 | Pecoraro | 2/102 |
| 4,128,902 | 12/1978 | Siebert | 2/2 |
| 4,183,097 | 1/1980 | Mellian | 2/2.5 |
| 4,185,327 | 1/1980 | Markve | 2/2 |
| 4,195,362 | 4/1980 | Rolando | 2/2 |
| 4,325,148 | 4/1982 | Livernois | 2/22 X |

*Primary Examiner*—Werner H. Schroeder

*Attorney, Agent, or Firm*—Willian Brinks Olds Hofer Gilson & Lione

[57] ABSTRACT

A protective body suit is described which includes a body suit formed of a stretchable material which defines a pair of leg openings, a pair of arm openings, and a neck opening. The body suit is sized and shaped to conform snugly to the chest and hips of a user, and the material can be either a closely woven or knit material or an open mesh material. A pair of resilient side pads are secured to the body suit between the arm openings and the aligned leg openings to protect the sides of the user. A pair of resilient shoulder pads are secured to the body suit between the neck opening and respective ones of the arm openings to protect the shoulders of the user. At least one resilient back pad is secured to the body suit between the side pads to protect the back of the user. The body suit is effective to hold the pads securely in place against the body of the user during athletic activity.

24 Claims, 4 Drawing Sheets

PROTECTIVE BODY SUIT

BACKGROUND OF THE INVENTION

The present invention relates to a protective body suit which is intended to be worn in athletic activities, such as in contact sports for example. The body suit of this invention may be used in any situation in which protection from spine, tailbone, rib, hip and shoulder injuries, as well as protection from abrasions and internal injuries, is desired.

Athletic injuries are a growing problem, and increased emphasis is being placed on sports safety. For example, various sports associations have recently promulgated new rules aimed at reducing athletic injuries. A need exists for improved protective equipment which will provide improved protection against athletic injuries, yet which will not inordinately burden a player with increased weight or significantly reduce the mobility and maneuvering ability of the player. Furthermore, it is important that such protective equipment be made as comfortable and functional as possible in order to enhance voluntary player compliance with safety rule requirements.

A wide variety of protective garments are known to the art. For example, U.S. Pat. No. 3,135,961 to Roderick discloses a free-hanging, padded T-shirt. This padded T-shirt does not, however, conform to the user's body in view of the free-hanging tail of the T-shirt. During athletic use of this protective garment, the protective padding may not always remain in its desired location against the chest of the user. Another protective athletic garment is shown in U.S. Pat. No. 4,128,902 to Siebert. FIG. 4 of this patent shows a gymnastic training leotard which incorporates a removable, protective pelvic area pad.

Other approaches to the problem of protective garments are shown, for example, in the shock-absorbing padded vest disclosed in U.S. Pat. No. 4,100,620 to Pecoraro, the air cell coverall suit shown in U.S. Pat. No. 4,185,327 to Markve, and the padded shock-resistant ski jacket shown in U.S. Pat. No. 4,195,362 to Rolando.

SUMMARY OF THE INVENTION

It is a primary object of the present invention to provide a protective body suit which provides protection for the spine, tailbone, ribs, hips, and shoulders of a user against physical impacts by both absorbing and distributing localized impacts over a larger body area of the user in order to reduce injuries associated with such impacts.

It is a further object of this invention to provide such a protective body suit in which the body suit conforms to the torso of the user resiliently in order to conform pads located over the spine, tailbone, ribs, hips and shoulders of the user to the torso of the user, and to hold these pads securely in place during athletic activity.

It is still another object of the present invention to provide such protection without imposing substantial penalties on the user in terms of increased weight or loss of mobility.

It is another object of the present invention to provide such a protective body suit which permits air circulation and passage of perspiration through the body suit to increase user comfort when the body suit is worn during athletic activity.

According to this invention, a protective garment is provided for a user, which garment comprises a body suit formed of a stretchable material which defines a pair of leg openings, a pair of arm openings, and a neck opening. The body suit is sized and shaped to conform to the chest and hips of the user. A pair of resilient, protective side pads are secured to the body suit, each located between a respective one of the arm openings and the associated leg opening to protect the sides of the user. A pair of resilient protective shoulder pads are secured to the body suit, each located between the neck opening and a respective one of the arm openings to protect the shoulders of the user. At least one resilient protective back pad is secured to the body suit between the side pads to protect the back of the user. The body suit of this invention is effective to hold the side pads, shoulder pads, and back pad securely in place against the body of the user during athletic activity.

In the present specification and claims, the term "body suit" is used to refer to a close-fitting, resilient garment sized to conform to the torso of the user and defining a neck opening, two arm openings, and two leg openings. Such garments are formed of a stretch material and include a crotch panel extending between the two leg openings, as well as shoulder panels extending between the neck opening and the respective arm openings. Such garments can be manufactured by any of a wide variety of weaving, knitting and other fabrication methods well known to the art.

The protective body suit of this invention provides important advantages in terms of extensive torso protection to the user. The resilient body suit operates to hold the pads securely in place, in conformity with the body of the user. The overall design can be embodied in a relatively low bulk, lightweight, comfortable undergarment which can be used in conjunction with conventional pads to enhance user safety. Furthermore, the protective body suit of this invention can be advantageously used by sports officials and referees in close contact sports under ordinary clothing.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
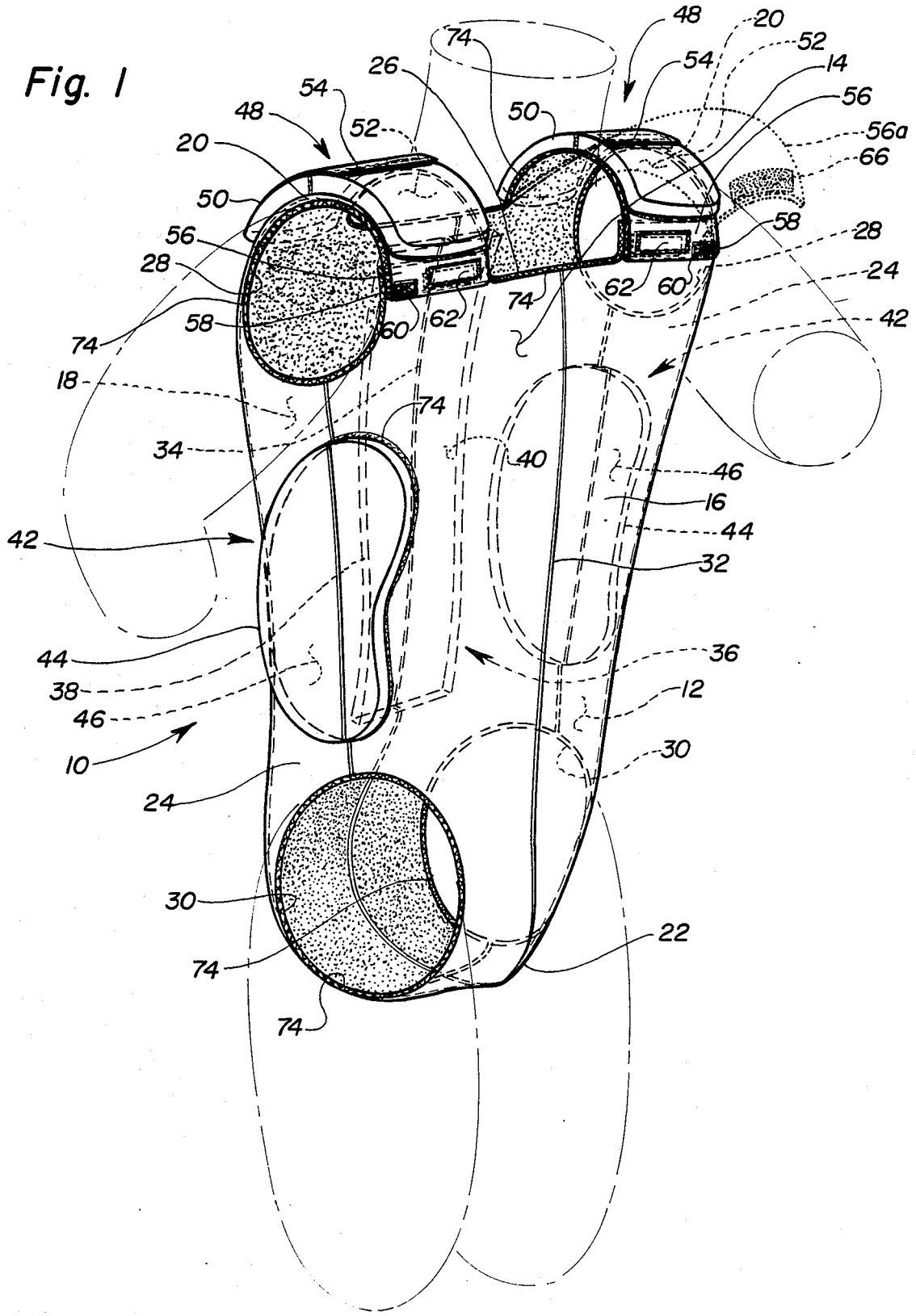
FIG. 1 is a front perspective view of a presently preferred embodiment of the protective body suit of this invention.

Turning now to the drawings, FIG. 1 shows a front perspective view of a protective body suit 10 which incorporates a presently preferred embodiment of the present invention. In FIG. 1, the protective body suit 10 is shown as it would appear in use on the torso of a user 12.

Prior to proceeding to a detailed description of the protective body suit 10, it should be noted that the protective body suit 10 includes a body suit garment 14 which may be made from any one or any suitable combination of a wide variety of stretch-type fabrics by standard manufacturing methods well known to those skilled in the art. The styling of the body suit 14 may be varied widely, but it is generally a pliable, form-fitting garment for the torso of a user which is typically formed of either a woven or a knit fabric or mesh.

The body suit 14 includes a front panel 16 and a back panel 18. As used herein, the term "panel" is intended in its broad sense to include specific areas or portions of a body suit, whether or not such specific areas are physically formed as distinct parts of the body suit. The front and back panels 16,18 are joined together at the top of the body suit 14 by a spaced pair of shoulder panels 20. At the bottom of the body suit 14, the front and back panels 16,18 are joined together by a centrally located crotch panel 22. A pair of laterally spaced side panels 24 interconnect the front and back panels 16,18 at the sides of the body suit 14.

As shown in FIG. 1, the panels 16,18,20,22,24 of the body suit 14 cooperate to define an upwardly facing, centrally located neck opening 26, two outwardly facing, laterally spaced arm openings 28, and two downwardly facing and laterally spaced leg openings 30.

In the preferred embodiment shown in the drawings, the front panel 16, which is generally rectangular in shape, defines a front panel seam 32 which extends vertically along a central portion of the front panel 16. Similarly, a back panel seam 34 defines a vertically oriented longitudinal axis extending vertically along a central portion of the generally rectangular back panel 18.

Figure 3:
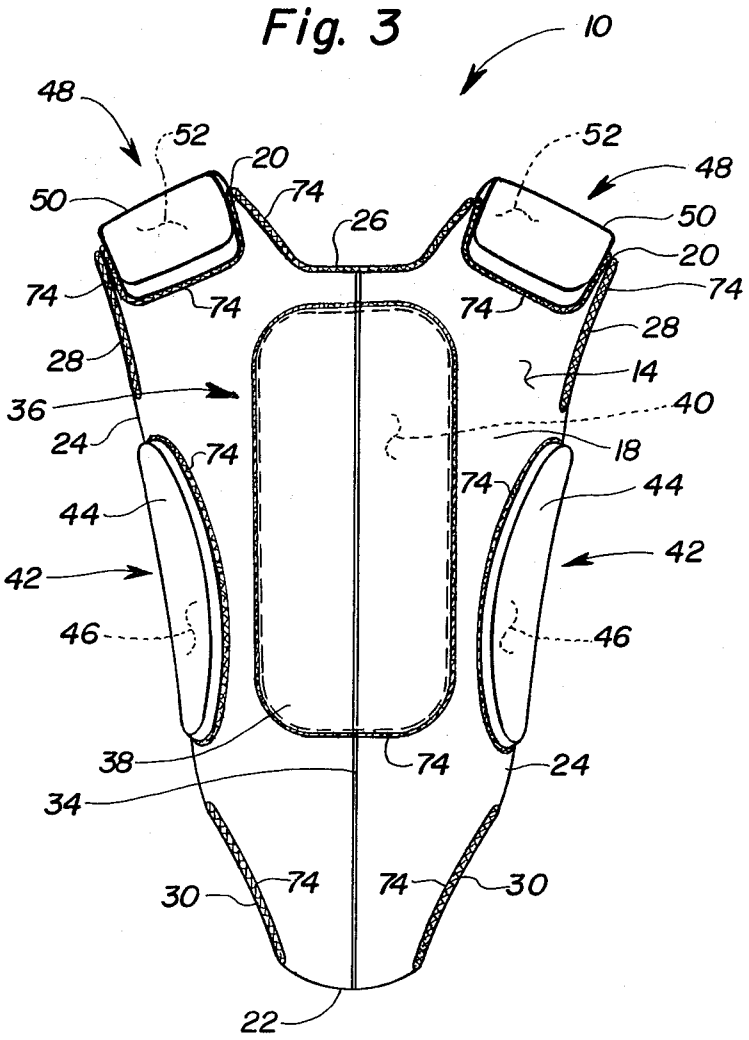
FIG. 3 is a back elevational view of the protective body suit of FIG. 1.
Figure 2:
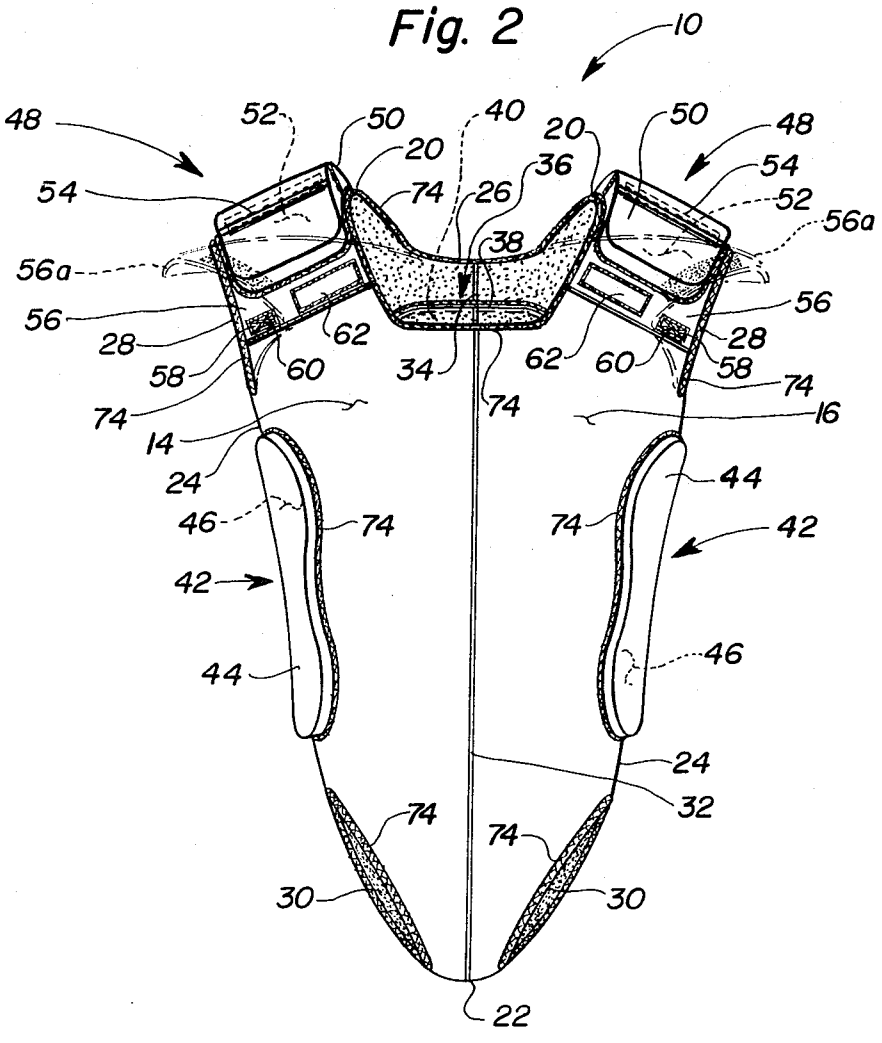
FIG. 2 is a front elevational view of the protective body suit of FIG. 1 in which two body suit closures are shown in phantom lines in an open position.

Also as shown in FIGS. 1–3, the protective body suit 10 is provided with a number of protective pad assemblies, each shaped and positioned to absorb and distribute localized physical impact over a large body area of the wearer, and thereby to reduce injuries and pain otherwise normally associated with such impacts. In order to provide broad protection to the user, these protective pad assemblies are positioned over the spine, tailbone, ribs, hips and shoulders of the user.

These protective pad assemblies include a back pad assembly 36 which includes an elongated back pocket 38. This back pocket 38 is stitched securely in place to the back panel 18 around its entire perimeter and is sized to receive a resilient back pad 40. As best shown in FIG. 3, this back pad 40 extends over the major portion of the back panel 18 and provides protection to the major portion of the spine and tailbone of the user.

In addition, the protective body suit 10 includes a pair of side pad assemblies 42, each of which is made up of a respective side pocket 44 and a respective side pad 46. As best seen in FIG. 1, each of these side pad assemblies 42 is generally kidney-shaped, and is disposed on a respective one of the side panels 24 to protect the side of the user. In each case, the side pockets 44 are sewn in place around their entire perimeter to the respective side panels 24 so as to capture the respective side pads 46 positively in place against the sides of the user.

A pair of shoulder pad assemblies 48 are positioned on the shoulder panels 20, respectively. Each of the shoulder panel assemblies 48 includes a fabric shoulder pocket 50 which is sewn in place on the respective shoulder panel 20. Each of the shoulder pockets 50 is sized to receive a respective shoulder pad 52 in place between the neck opening 26 and a respective one of the arm openings 28. As will be explained in greater detail below in conjunction with FIGS. 4 and 5, each of the shoulder pockets 50 is provided with a shoulder pocket flap 54 which can be opened to allow the shoulder pad 52 to be removed from the shoulder pocket 50. In this embodiment, each of the shoulder pads 52 can be inserted in or removed from the respective shoulder pocket 50 as desired by the user.

The protective body suit 10 also includes two body suit closures 56. These closures 56 will be described below in greater detail in conjunction with FIGS. 6 and 7. Here, it is enough to state that each of the closures 56 can be opened to the position shown in phantom lines in FIG. 1 at reference numeral **56*a* to enlarge the neck opening 26 in order to make it easier for the user to put on the protective body suit 10. Once the protective body suit 10 is in place, the user can then close the body suit closures 56 in order to ensure that the body suit 14 conforms closely to the body of the user and holds each of the pads 40,46,52** properly in place.

When properly adjusted, the protective body suit 10 provides a high degree of wearer comfort as well as high degree of protection to the torso, spine, tailbone, hips, ribs, and shoulders of the user during athletic activities. The body suit 14 causes each of the pads 40,46 and 52 to conform to the body of the user, and the body suit 14 acts to hold each of the pads properly in place during athletic activity.

As previously mentioned, the body suit 14 can be made of any suitable natural, synthetic, or combination material or mesh, either woven or knit. In the presently preferred embodiment, the body suit 14 and each of the pockets 38,44,50 are formed of a resilient fabric such as a stretch knit formed of 13 filament, 40 denier Antron T-865 (88%) and 40 denier Lycra T-129 (12%) having a warp stretch of about 140%, a width stretch of about 100%, a weight of about 6 ounces per square yard, a fabric count of about 75 stitches per inch, and about 51 wales per inch.

Each of the pads 40,46,52 can be made from suitable resilient materials which can be formed of either natural or synthetic bases. In this preferred embodiment, each of the pads 40,46,52 is formed of a closed cell polymer sponge sheet material formed of ethylene propylene terapolymer polyethylene butyl of softness RE-41 marketed under the tradename "RUBATEX" by the Rubatex Corporation of Bedford, Virginia. The thickness of the pads 40,46,52 can be varied as desired. However, in the presently preferred embodiment, these pads are three-eighths of an inch in thickness.

Figure 6:
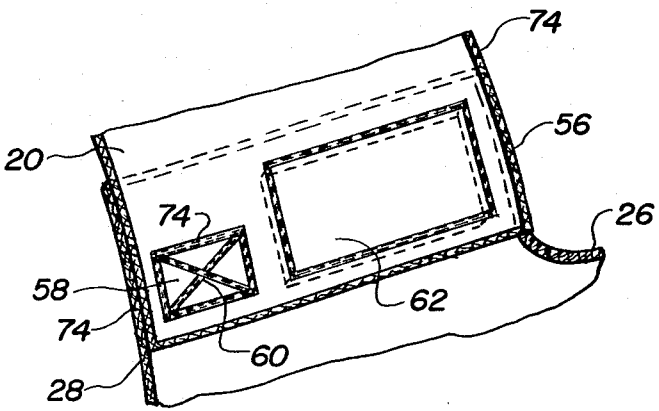
FIG. 6 is an enlarged front elevational view of one of the closures of the protective body suit of FIG. 1 in a secured position.
Figure 7:
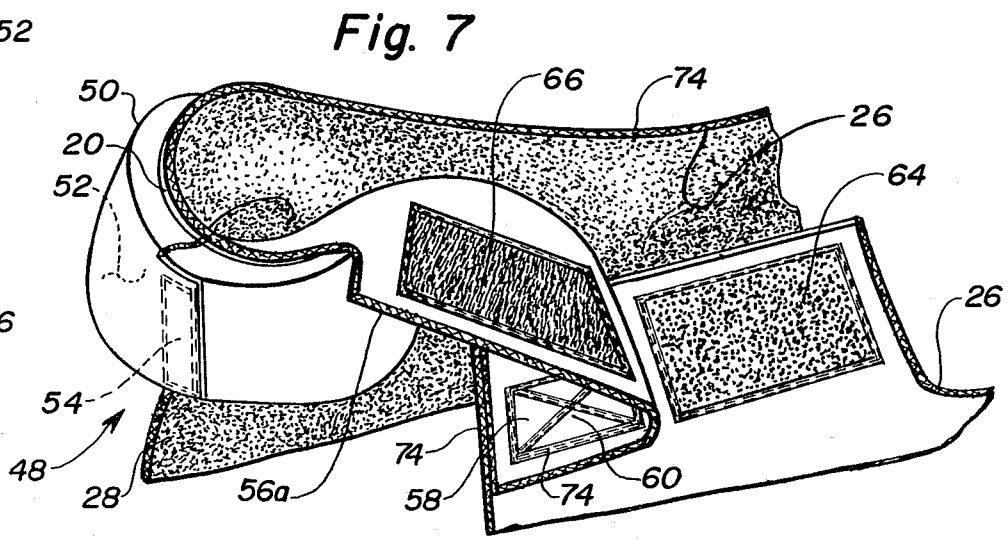
FIG. 7 is an enlarged fragmentary perspective view of the closure of FIG. 6 in an open configuration.

Turning now to FIGS. 2, 6 and 7, each of the body suit closures 56 is formed at the junction between one of the uppermost portions 17 of the front panel 16, and the forwardmost portion 21 of one of the shoulder panels 20.

As best shown in FIGS. 6 and 7, the portions 17 and 21 of the front and shoulder panels 16 and 20 are secured together at a region 58 near the respective arm opening 20, as for example by reinforced stitching 74. A hook and loop fastener 62 such as a fastener of the type marketed under the trade name Velcro is secured to mate overlapping portions of the front panel 16 and the shoulder panel 20. In this embodiment, a hook tab 64 is secured to the upper side of the uppermost portion 17 of the front panel 16, and a loop tab 66 is secured to the underside of the forwardmost portion 21 of the shoulder panel 20. Both the hook tab 64 and the loop tab 66 are positioned adjacent to the region 58 of reinforced stitching 74.

As shown in FIGS. 1 and 2 in solid lines and in FIG. 6, the hook and loop fasteners 62 can be used to secure the body suit closures 56 in a closed position during athletic use of the protective body suit 10. When it is desired to enlarge the neck opening 26 to make it easier to put the protective body suit 10 on or to take it off, the hook and loop fasteners 62 can be opened (as shown in phantom lines at reference numeral **56*a* in FIGS. 1 and 2, and as shown in FIG. 7**).

Figure 4:
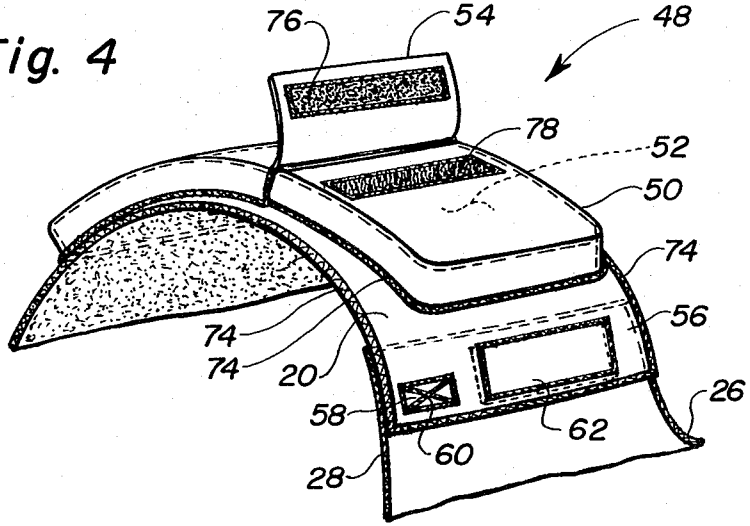
FIG. 4 is an enlarged front perspective view of an upper portion of the protective body suit of FIG. 1.
Figure 5:
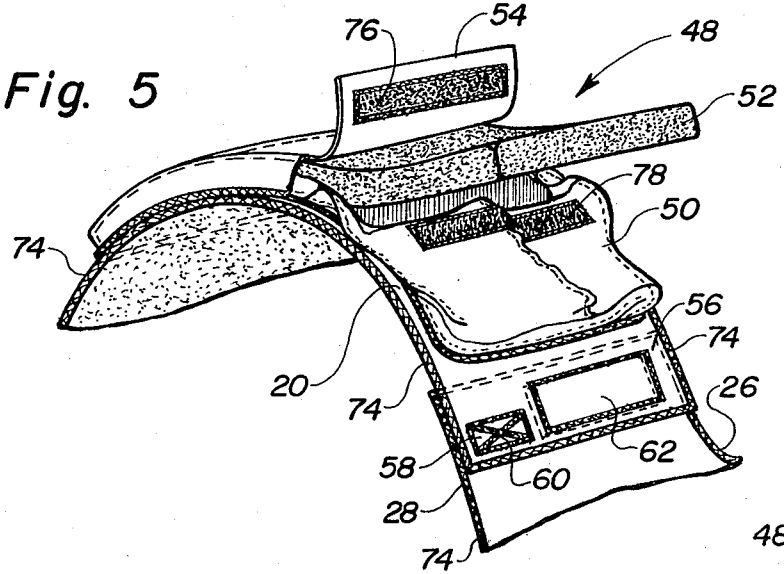
FIG. 5 is an enlarged front perspective view corresponding to FIG. 4 showing one of the shoulder pads partially removed from its pocket.

FIGS. 4 and 5 show the manner in which the shoulder pad assemblies 48 allow the shoulder pads 52 to be inserted in and removed from the shoulder pockets 50. Each of the shoulder pocket flaps 54 is provided with a loop tab 76, and each of the shoulder pockets 50 is provided with an overlappingly disposed hook tab 78. When the loop and hook tabs 76,78 are interlocked, the shoulder pocket 50 is securely closed and the shoulder pad 52 is securely held in place. However, when it is desired to remove the shoulder pad 52, the shoulder pocket 50 can readily be opened by lifting the shoulder pocket flap 54 and separating the loop and hook tabs 76,78.

As shown in the FIGS. 1–7, the neck, arm and leg openings 26,28,30 and the back, side and shoulder pockets 38,44,50 are in this embodiment all either hemmed or affixed in place by means of reinforced stitching 74.

Figure 8:
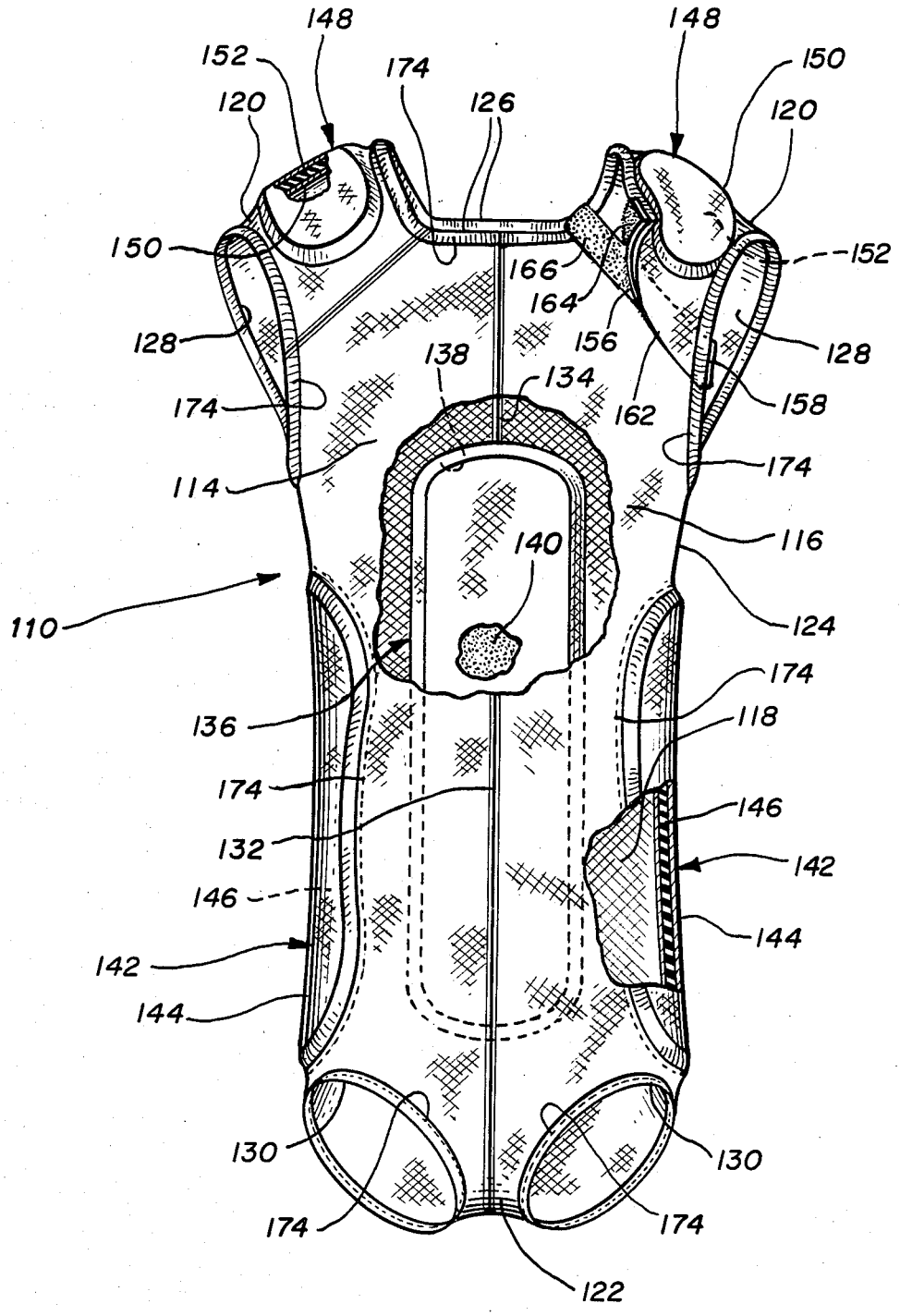
FIG. 8 is a front elevational view of a second preferred embodiment of this invention.

FIG. 8 shows a front elevational view of a second preferred embodiment of this invention which is similar in many respects to the first preferred embodiment described above. Corresponding elements in the two embodiments have been marked with reference numerals which correspond in the last two digits. For example, the front panel 16 of FIG. 1 corresponds to the front panel 116 of FIG. 8. The following discussion will focus on four areas in which the embodiment of FIG. 8 differs from the embodiment of FIGS. 1–7.

First, the body suit garment 114 is formed of a stretchable material which defines a mesh. This garment 114 provides the same pad locating functions and is form fitting in the same manner as the garment 14. The mesh material provides a cooler garment which is more comfortable in many athletic activities. In this embodiment, the mesh material is formed of 100 denier, 34 filament Nylon T-285 (88%) knit with 280 denier Lycra T-127 (12%), having a weight of about 5.4 ounces per square yard, a warp stretch of about 170%, a fabric count of about 85 stitches per inch, and about 18 wales per inch.

Second, the side pads 146 have been lowered somewhat as compared with the side pads 46. The lower position of the side pads 146 has been found preferable in some cases when the protective body suit is used in football activities.

Third, the shoulder pads 152 are sewn in place in the same manner as the side pads 146, and the shoulder pad assemblies 148 are not provided with pocket flaps of the type described above in connection with the first embodiment. In this respect the embodiment of FIG. 8 is simpler and more economical in manufacture than the embodiment of FIGS. 1–7.

Fourth, the body suit closure 156 has been modified with respect to the closures 56. In particular, only one closure 156 is included in the protective body suit 110, and this closure 156 opens to a greater extent, due to the fact that the region 158 of reinforced stitching 174 is immediately adjacent to the associated arm opening 128. In the embodiment of FIG. 8, the closure 156 is made up of a hook and loop fastener, 1½ inches in width, which extends between the arm opening 128 and the neck opening 126.

In view of the foregoing description, it should be apparent that two embodiments of a protective body suit have been described which conform to the body of the user and which hold a set of protective pads securely in place against the shoulders, sides and back of the user. The protective body suit of this invention can be used either alone as a protective device, or in combination with other protective devices such as shoulder pads and the like. Thus, this invention can be used to enhance and complement the basic protection generally provided by standard athletic equipment. The protective body suit of this invention provides abrasion protection whether used alone or in combination with other athletic safety equipment. In addition, the protective body suit of this invention reduces skin chafing caused by frictional movement of athletic equipment against the body.

Of course, it should be understood that a wide range of changes and modifications can be made to the preferred embodiment described above. For example, any of the pads can be made so as to be readily removable if desired, and any of the pads can be firmly captured in place if desired. Furthermore, materials and dimensions can readily be altered to suit individual applications. In addition, alternative closure devices, such as snaps, zippers, or the like, may be preferable for some applications, and closure devices on the body suit may be entirely eliminated, or repositioned to a lower portion of the body suit such as the front panel or the crotch panel for some applications. It is therefore intended that the foregoing detailed description be regarded as illustrative rather than limiting, and that it be understood that it is the following claims, including all equivalents, which are intended to define the scope of this invention.

I claim:

1. A protective garment for a user comprising:

a body suit formed of an elastic, resilient, stretch material, said body suit defining a pair of leg openings, a pair of arm openings, and a neck opening, said body suit sized and shaped to conform snugly to the chest and hips of the user;

a pair of resilient, protective side pads secured fixedly in position to the body suit, each located between a respective one of the arm openings and the associated leg opening to protect the sides of the user; and a pair of resilient, protective shoulder pads secured fixedly in position to the body suit, each located between the neck opening and a respective one of the arm openings to protect the shoulders of the user;

said body suit shaped not to cover the knees of the user;

said body suit effective to hold the side pads and shoulder pads securely in place against the body of the user during athletic activity of the user.

2. The invention of claim 1 wherein the body suit defines a plurality of pockets, each sized to receive and retain a respective one of the pads.

3. The invention of claim 2 wherein at least some of the pockets are completely closed to capture the respective pads in place.

4. The invention of claim 2 wherein means are provided for releasably closing at least some of the pockets such that the respective pads are removable from the body suit.

5. The invention of claim 1 wherein the body suit defines at least one closure extending between the neck opening and one of the arm openings, and wherein securing means are provided for releasably holding the closure in a closed position.

6. The invention of claim 5 wherein the securing means comprises a hook and loop fastener.

7. The invention of claim 1 wherein each of the pads is formed of a closed cell polymer material.

8. The invention of claim 1 wherein the body suit stretchable material defines an open mesh.

9. A protective garment for a user comprising:

a body suit formed of an elastic, resilient, stretch material, said body suit defining a pair of leg openings, a pair of arm openings, and a neck opening, as well as a back portion, a pair of side portions, and a pair of shoulder portions, said body suit shaped and sized to conform to the body of the user and to fit snugly against the body of the user during athletic activity;

a pair of side pockets, each secured to a respective one of the side portions of the body suit;

a pair of resilient side pads, each confined in a respective one of the side pockets;

a pair of shoulder pockets, each secured to a respective one of the shoulder portions of the body suit; and a pair of resilient shoulder pads, each confined in a respective one of the shoulder pockets;

said body suit shaped to terminate above the knees of the user;

said body suit cooperating with the pockets to hold the pads securely in place against the body of the user during athletic activity to provide protection to the sides, shoulders and back of the user.

10. The invention of claim 9 wherein at least some of the pockets are completely closed to capture the respective pads in place against the body suit.

11. The invention of claim 9 wherein means are provided for releasably closing at least some of the pockets such that the respective pads are removable from the body suit.

12. The invention of claim 9 wherein the body suit defines at least one closure extending between the neck opening and one of the arm openings, and wherein securing means are provided for releasably holding the closure in a closed position.

13. The invention of claim 12 wherein the securing means comprises a hook and loop fastener.

14. The invention of claim 9 wherein each of the pads is formed of a closed cell polymer material.

15. The invention of claim 9 wherein the body suit stretchable material defines an open mesh.

16. A protective undergarment for a user comprising:

a body suit formed of a resilient, elastic, stretch material, said body suit comprising a front panel, a back panel, two side panels which interconnect the front and back panels at respective sides of the body suit, a crotch panel which interconnects the front and back panels at a lower portion of the body suit, and two shoulder panels which interconnect the front and back panels at respective upper portions of the body suit, said panels cooperating to define a neck opening between the side panels, two opposed arm openings between the shoulder panels and the respective side panels, and two leg openings between the crotch panel and the respective side panels, all of the openings being positioned between the front and back panels, said body suit shaped and sized to conform to and fit the torso of the user snugly, smoothly, and resiliently;

a back pocket disposed centrally on the back panel;

a resilient back pad disposed in the back pocket and extending up at least as high as a lower portion of the arm openings, said back pad covering at least 50 percent of the back panel;

a pair of side pockets each disposed on a respective one of the side panels;

a pair of resilient side pads, each disposed in a respective one of the side pockets, each of said side pads covering at least 50 percent of the respective side panel;

a pair of shoulder pockets, each disposed on a respective one of the shoulder panels;

a pair of resilient shoulder pads, each disposed in a respective one of the shoulder pockets, each of said shoulder pads covering at least 50 percent of the respective shoulder panel; and means for releasably securing an upper portion of the front panel to a mating portion of one of the shoulder panels adjacent to the neck opening to allow the neck opening to be temporarily enlarged;

said body suit shaped not to cover the knees of the user;

said body suit and pockets cooperating to conform the pads to the torso of the user and to hold the pads securely in place against the torso of the user during athletic activity.

17. The invention of claim 16 wherein the back pocket and the side pockets are closed to capture the respective pads in place on the body suit, and wherein the shoulder pockets are releasably closed such that the shoulder pads are readily removable from the body suit.

18. The invention of claim 16 wherein the pads are formed of a closed cell polymer material.

19. The invention of claim 16 wherein the body suit resilient material defines an open mesh.

20. The invention of claim 1 wherein the body suit does not cover the legs of the user.

21. The invention of claim 9 wherein the body suit does not cover the legs of the user.

22. The invention of claim 16 wherein the body suit does not cover the legs of the user.

23. The invention of claim 1 further comprising at least one resilient, protective back pad secured to the body suit between the side pads to protect the back of the user.

24. The invention of claim 9 further comprising:

at least one back pocket secured to the back portion of the body suit; and at least one resilient back pad confined in the back pocket to protect both the spine and the tailbone of the user.

* * * * *